United States Patent [19]

Liu et al.

[11] Patent Number: 4,635,536

[45] Date of Patent: Jan. 13, 1987

[54] CYLINDER LOCKING APPARATUS

[75] Inventors: Ming Liu, Westmont; John F. Bowbin, Elmhurst, both of Ill.; Raymond L. Ghislain, Twin Lakes, Wis.; Stephen K. McDaniel, Glen Ellyn, Ill.

[73] Assignee: Miller Fluid Power Corporation, Bensenville, Ill.

[21] Appl. No.: 734,742

[22] Filed: May 14, 1985

Related U.S. Application Data

[63] Continuation of Ser. No. 534,171, Sep. 19, 1983, abandoned.

[51] Int. Cl.[4] ..... F15B 15/26

[52] U.S. Cl. ..... 92/24; 92/28

[58] Field of Search ..... 92/23, 24, 27, 28, 255; 91/41, 44

[56] References Cited

U.S. PATENT DOCUMENTS

| | | | |
|---|---|---|---|
| 2,393,962 | 2/1946 | Ashton et al. | 92/24 |
| 3,476,014 | 11/1969 | Churchill, Jr. et al. | 92/255 |
| 3,498,182 | 3/1970 | Sheffer et al. | 92/24 |
| 3,786,724 | 1/1974 | Martin | 92/255 |
| 3,889,576 | 6/1975 | Sheffer et al. | 92/24 |
| 3,918,346 | 11/1975 | Ziegler | 92/28 |

FOREIGN PATENT DOCUMENTS

| | | | |
|---|---|---|---|
| 0715461 | 12/1941 | Fed. Rep. of Germany | 92/24 |
| 715739 | 1/1942 | Fed. Rep. of Germany | 92/24 |
| 725770 | 9/1942 | Fed. Rep. of Germany | 92/24 |
| 0340632 | 3/1936 | Italy | 92/24 |
| 521657 | 5/1940 | United Kingdom | 92/24 |

*Primary Examiner*—Edward K. Look

*Attorney, Agent, or Firm*—Wood, Dalton, Phillips, Mason, and Rowe

[57] ABSTRACT

Locking apparatus for a piston and cylinder device includes a locking plunger connected to the piston and disposed between the piston and an end cap of the piston and cylinder device. The locking plunger includes a sleeve which carries a plurality of radially movable ball bearings. As the piston is moved toward an extreme position of the device, the ball bearings contact a spring loaded locking plug disposed in the head of the device, thereby moving the plug away from a first position. The piston and locking plunger continue to move the locking plug away from the first position until the balls are aligned with a circumferential groove or channel in the head. At this point the locking plug is moved to the first position under spring force, in turn moving the ball bearings radially outward into engagement with the channel or groove. The piston and piston rod of the device are thereby locked in position in the absence of fluid pressure. The locking plug includes surfaces against which pressurized fluid acts at the beginning of a return stroke to move the plug away from the first position and release the ball bearings from the channel. The piston is thereby unlocked and is free to move toward the other extreme position of the device.

3 Claims, 14 Drawing Figures

FIG. 1
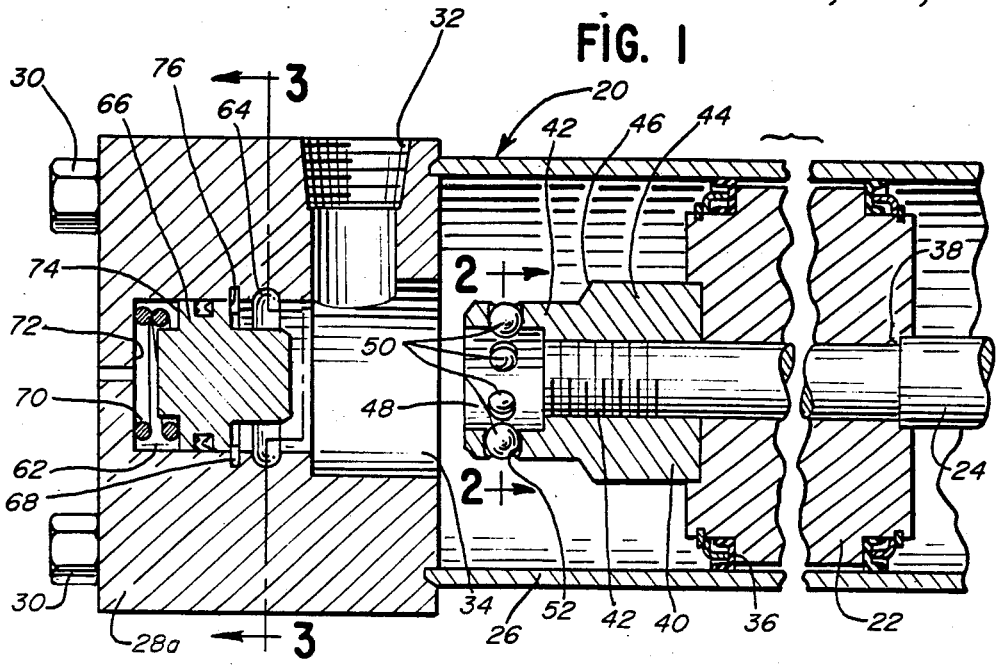
FIG. 2B
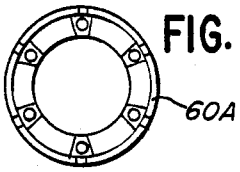
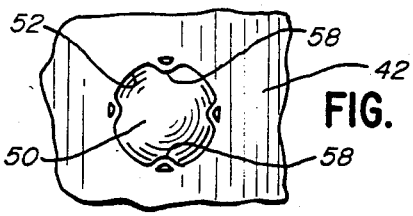
FIG. 5
FIG. 2A
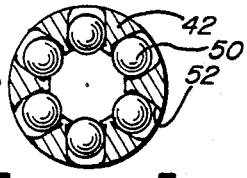
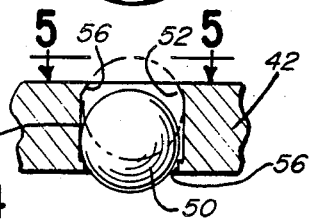
FIG. 4
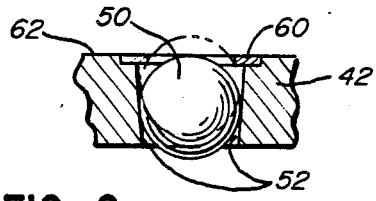
FIG. 6
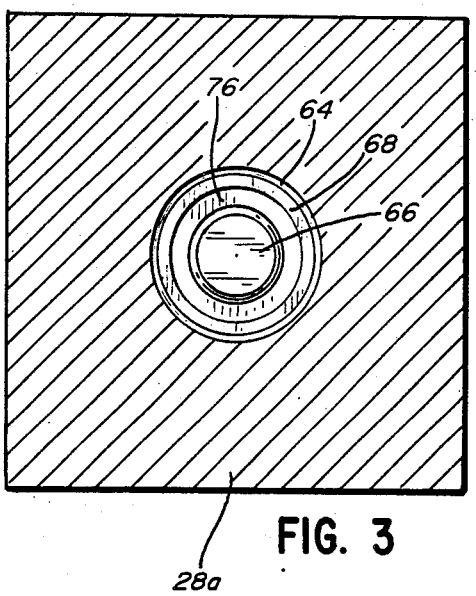
FIG. 3

CYLINDER LOCKING APPARATUS

This is a continuation of co-pending application Ser. No. 534,171, filed on Sept. 19, 1983, now abandoned.

BACKGROUND OF THE INVENTION

The present invention relates generally to piston and cylinder devices, and more particularly to a lock for holding a piston in a cylinder at one of two extreme positions.

One prior device for locking a piston and piston rod at an extreme position in a cylinder is disclosed in Powers et al. U.S. Pat. Nos. 2,946,313 and 2,959,155. A latching stem is secured to a piston of a fastener driving tool. The latching stem includes an annular channel which is engaged by ball bearings mounted in the cylinder to lock the piston in place therein. The piston is unlocked by admitting pressurized fluid into the cylinder which causes a release sleeve to move upwardly. This movement allows the ball bearings to move out of engagement with the latching stem channel and permit the latching stem and piston to move within the cylinder.

A different type of locking device is disclosed in Skelton et al. U.S. Pat. No. 3,397,620. This patent discloses locking means in the form of a series of ball bearings disposed in a head or cap of the cylinder which engage a concentric groove on the end of a piston rod. The balls are urged inwardly into engagement with the groove by a cam surface of a circumferential spring-loaded ring member, also disposed in the head or cap. The locking action is overcome by the admission of pressurized fluid which acts against the ring member to move it against the spring force and release the ball bearings from the groove.

The devices shown in the above patents are quite complex in that they require a plurality of springs, complicated and/or numerous seals and/or special apparatus for mounting the various components of the locking devices to the head and/or cylinder.

Furthermore in the Powers et al. apparatus, the locking components are mounted by means of a bolt which extends through an end cap of the device, thereby providing a path for contaminants to enter the cylinder.

The apparatus shown in Skelton et al. utilizes an end plate bolted to a head or cap of the cylinder which carries the locking components. This device uses seals associated with the ring member to minimize leakage of pressurized fluid. However, these seals do not prevent contaminants from entering a spring chamber which houses springs in the end plate for loading the ring member. Also, once the ring member is moved to compress the springs, the seals create a vacuum in the spring chamber tending to oppose the force of the springs, in turn impairing the function of the device.

SUMMARY OF THE INVENTION

In accordance with the present invention, a cylinder locking apparatus for a piston and cylinder device allows a piston to be locked at one of two extreme positions in a cylinder. The apparatus is simple in construction, does not allow contaminants to enter the cylinder and does not create a vacuum tending to oppose the locking action.

The locking apparatus includes a plurality of ball bearings disposed in radial bores extending outwardly from a central bore in a carrier connected to a piston and/or piston rod of the device. An axial bore is disposed in a head of the device and aligned with the carrier. The axial bore has a diameter slightly greater than the diameter of that portion of the carrier in which the ball bearings are disposed. A locking plug is spring mounted within the axial bore and includes a tapered nose engageable with the ball bearings as the piston is moved toward the head of the device to move the locking plug against the spring force until such time as the ball bearings are aligned with the groove. At this point, the locking plug moves in a direction opposite to the direction of travel of the piston in response to the spring force to move the ball bearings outwardly into engagement with the groove. The piston and piston rod are therefore locked in position within the cylinder, which locking action is effective even in the absence of fluid pressure.

The locking plug also includes a surface against which pressurized fluid acts at the beginning of a return stroke to move the locking plug against the spring force to thereby release the balls from the groove and permit the piston and piston rod to move away from the head.

The head may be either of integral or two-piece construction, with means for venting any fluid leakage past the locking plug back to an exhaust line to prevent contamination of components within the cylinder without creating a vacuum tending to oppose the motion imparted by the spring on the locking plug.

BRIEF DESCRIPTION OF THE DRAWINGS

FIG. 1 is a broken elevational view, partly in section, of a piston and cylinder device incorporating the locking apparatus of the present invention;

FIGS. 2A and 2B are sectional views taken along line 2—2 of FIG. 1 showing alternative ways of retaining ball bearings in radial bores;

FIG. 3 is a transposed sectional view taken along lines 3—3 of FIG. 1;

FIG. 4 is an enlarged fragmentary view of one of the ball bearings shown in FIG. 1;

FIG. 5 is a plan view taken along lines 5—5 of FIG. 4;

FIG. 6 is a view similar to FIG. 4 showing an alternative embodiment for retaining the ball bearing in a radial bore;

DESCRIPTION OF THE PREFERRED EMBODIMENT

Figure 8:
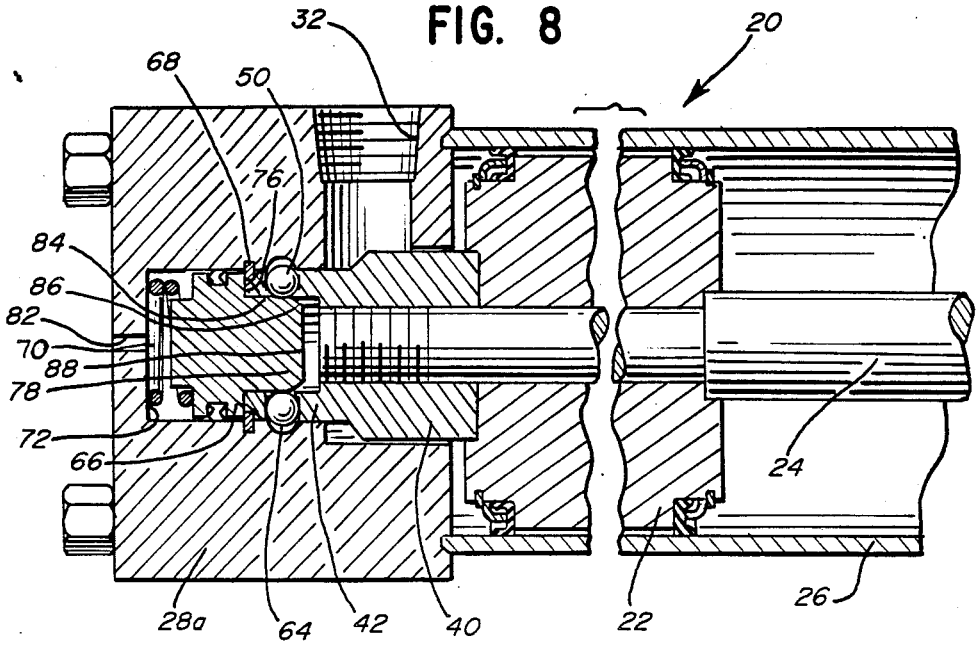
FIGS. 7 and 8 are views similar to FIG. 1 illustrating the operation of the locking apparatus of the present invention.

Referring now to FIG. 1, a piston and cylinder device 20 includes a piston 22 mounted on a piston rod 24 within a cylinder 26. The cylinder 26 includes at each end a head 28, with one of the heads **28*a* illustrated in FIG. 1 and the other head 28*b* illustrated in FIG. 11. The heads 28 are secured to the cylinder by means of tie rods (not shown) and nuts 30 which are torqued to cause the heads to intimately engage the cylinder 26**.

The head 28*a* includes a fluid port 32 which communicates through a head bore 34 to the interior of the cylinder 26.

The piston is movable between extreme positions abutting one of the heads 28*a*, 28*b* in response to the admission of pressurized fluid within the cylinder on one side of the piston. The piston includes seals 36 to prevent the passage of pressurized fluid past the space between the piston 22 and the cylinder 26.

The piston rod 24 extends through the piston 22 and includes a shoulder 38 against which the piston 22 abuts. The piston 22 is held firmly against this shoulder 38 by means of a locking plunger or carrier 40 which is secured to the piston rod 24 by means of threads 42. It should be noted that the piston 22 may be held against the shoulder 38 by means of a separate nut, retaining ring, or the like, if desired.

The locking plunger or carrier 40 includes a forwardly disposed sleeve portion 42, a main portion 44 and a tapered transition portion 46 disposed between the sleeve and main portions.

The sleeve 42 includes a central axial bore 48 such that the sleeve 42 has a first or outer diameter and a second or inner diameter. A series of locking members 50 in the form of ball bearings are disposed in radial bores 52 spaced circumferentially about the central bore 48. Equivalent locking members, such as radially extending dogs or the like may be used in place of the ball bearings, if desired.

In the preferred embodiment, and as seen more specifically in FIG. 2A, six ball bearings are disposed in radial bores 52 spaced equally about the periphery of the bore 48. A different number of ball bearings may be utilized, if desired, depending upon the load attached to the piston rod. The ball bearings 50 are radially movable within the bores 52 between a first position, shown in FIGS. 4 and 6, and a second or locking position shown by the broken lines in FIGS. 4 and 6.

As seen in FIG. 4, in a first embodiment the bores 52 each include a main or center portion 54 having a diameter slightly greater than the diameter of the ball bearing 50 disposed therein and reduced diameter portions 56 at each end of the bore, each having a diameter less than the diameter of the ball bearing disposed therein.

The radial bore 52 shown in FIG. 4 may be constructed by drilling or otherwise machining a hole having a diameter equal to the diameter of the reduced diameter portion 56 at the radially inner end of the bore 52 and drilling or otherwise machining a second hole to a depth less than the thickness of the sleeve 42 from the radially outer end of the bore 52 so that a small flange is formed at the radially inner portion of the bore 52. As seen in FIG. 5, the metal at the radially outer portion of the sleeve 42 may then be upset or otherwise deformed to form inwardly extending lobes 58 which permit limited travel of the ball within the bore 52 and yet prevent the ball from completely escaping therefrom.

In an alternative embodiment shown in FIG. 6, the bore 52 may be tapered so that the diameter of the bore at the innermost portion thereof is less than the diameter of the ball bearing 50 held therein. A keeper ring 60 having an inner diameter less than the diameter of the ball is to be secured in a counterbore 62 at the radially outer end of the bore 52 to allow limited travel of the ball bearing 50 between reduced diameter portions as previously noted.

Alternately, as seen in FIG. 2B, the individual keeper rings 60 may be replaced by a split circular ring 60A which fits into a circumferential groove into the carrier 44. The outer diameter of the carrier is upset to hold the circular ring securely. The circular ring 60A has individual holes whose diameter is less than the diameter of the ball bearing which permits the capturing effect and movement of the ball bearing 50 as previously noted.

Referring now specifically to FIGS. 1 and 3, a second or plug bore 62 communicates with the head bore 34. The plug bore 62, the head bore 34 and the locking plunger or carrier 40 are all disposed concentrically with the piston 22 and piston rod 24. The diameter of the plug bore 62 is slightly greater than the outer diameter of the sleeve 42.

A circumferential groove 64 extends outwardly from the plug bore 62. The groove 64 is of a size to receive and be engaged by the ball bearings 50, as noted more specifically below.

A locking plug 66 is disposed within the plug bore 62 and is held against a stop in the form of a snap ring 68 by a spring 70 disposed between an end face 72 of the head 28*a* and a first shoulder 74 of the plug 66. The plug 66 is movable between a first position wherein a second shoulder 76 of the plug 66 contacts the stops 68 and a second position wherein the shoulder 76 is spaced away from the stop 68.

Figure 7:
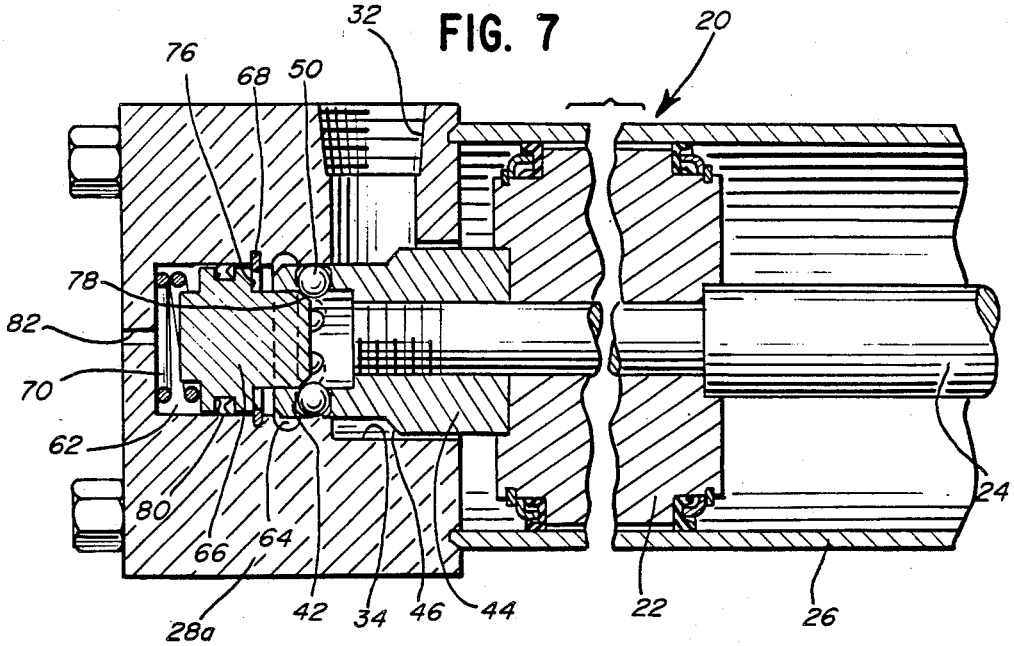

Referring now to FIG. 7, the operation of the device is illustrated under the assumption that the piston 22 and piston rod 24 are moving to the left in response to the admittance of pressurized fluid in the cylinder 26.

As the locking plunger or carrier 40 moves from the position shown in FIG. 1 toward the position shown in FIG. 7, the transitional portion 46 and the main portion 44 of the carrier 40 enter the head bore 34. The outer diameter of the main portion 44 is slightly smaller than the diameter of the head bore 34 and hence pressurized fluid between the piston 22 and the head 28*a* is metered into the fluid port 32. This metering slows down the rate of travel of the piston 22 and piston rod 24 as the extreme position is approached to cushion the impact of the piston 22 against the head 28*a*. Additional cushioning devices may be utilized, or not used, if desired.

As the piston and piston rod continue to travel to the left, the sleeve 42 enters the plug bore 62 so that the ball bearings are trapped between the outer wall of the plug bore 62 and a tapered nose 78 of the locking plug 66. As the piston and piston rod continue to advance to the left, the locking plug 66 is moved away from the first position so that the second shoulder 76 is spaced from the stop 68. The locking plug 66 continues to move away from the stop 68 until the ball bearings 50 are axially aligned with the circumferential groove 64. During this time, a radial seal 80 disposed between the plug 66 and the bore 62 prevents pressurized fluid from escaping in significant quantities around the plug 66.

When the ball bearings 50 are in axial alignment with the groove 64, the spring 70 moves the locking plug 66 to the first position against the stop 68, thereby causing the ball bearings 50 to ride onto a cylindrical surface 84 from a tapered surface 86 of the tapered nose 78. The ball bearings therefore move into engagement with the circumferential groove 64, as seen in FIG. 8. The piston and piston rod are consequently positively held in a locked position in the absence of fluid pressure.

Contamination of the components within the cylinder is prevented by means of an exhaust port 82 which may be connected to an exhaust line to return any escaped fluid back to a reservoir. The port 82 also prevents the creation of a vacuum in the space between the locking plug 66 and the end face 72 so that movement of the locking plug 66 and the bore 62 is not hindered thereby.

The exhaust port 82 may alternatively be connected through a filter 83 (shown in phantom in FIGS. 9 and 10) so that contamination is kept at a minimum and noise is reduced.

At the beginning of a return stroke of the piston, pressurized fluid enters the head bore 34 and the plug bore 62 from the fluid port 32. The locking plug 66 includes surfaces against which this pressurized fluid acts comprising the second shoulder 76, the cylindrical surface 84 and tapered surface 86 of the tapered nose 78 and an end surface 88 of the plug 66. The fluid pressure on these faces creates a pressure differential across the locking plug 66. This pressure forces the locking plug 66 away from the stop 68 against the urging of the spring 70 so that the ball bearings 50 are no longer held in the channel by the tapered nose 78. The ball bearings 50 are consequently free to disengage from the groove or channel 64, in turn unlocking the piston 22 from the extreme position and allowing the piston to move away from the head 28*a*.

Figure 9:
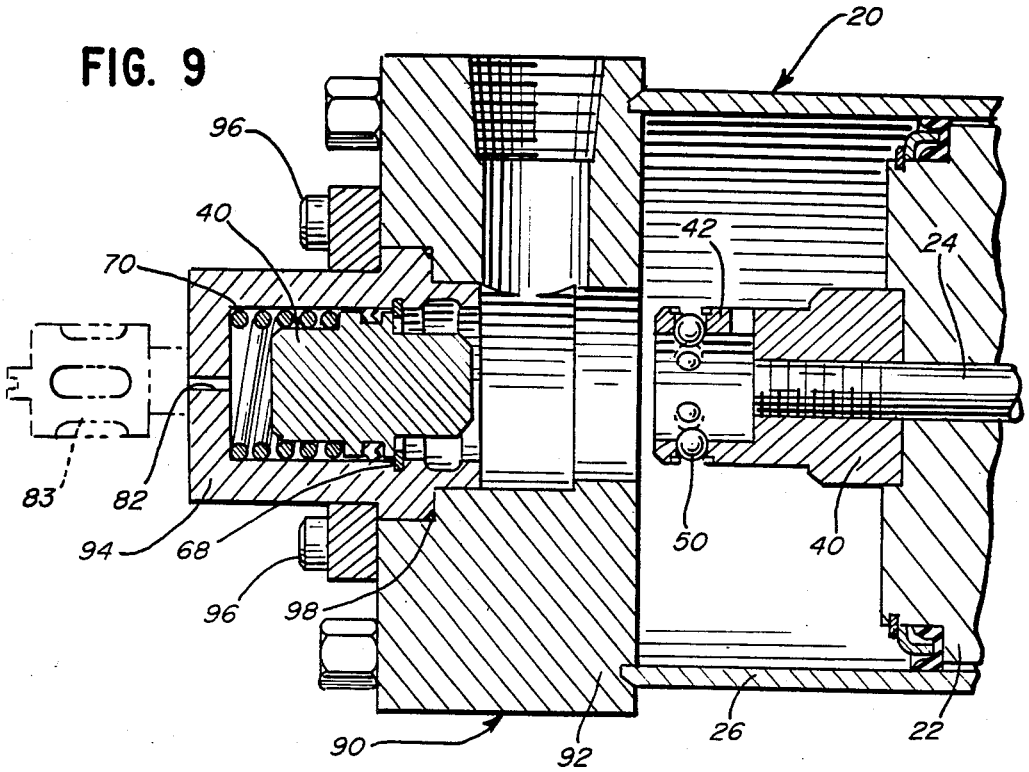
FIGS. 9 and 10 are views similar to FIG. 1 showing a further embodiment of the invention.
Figure 10:
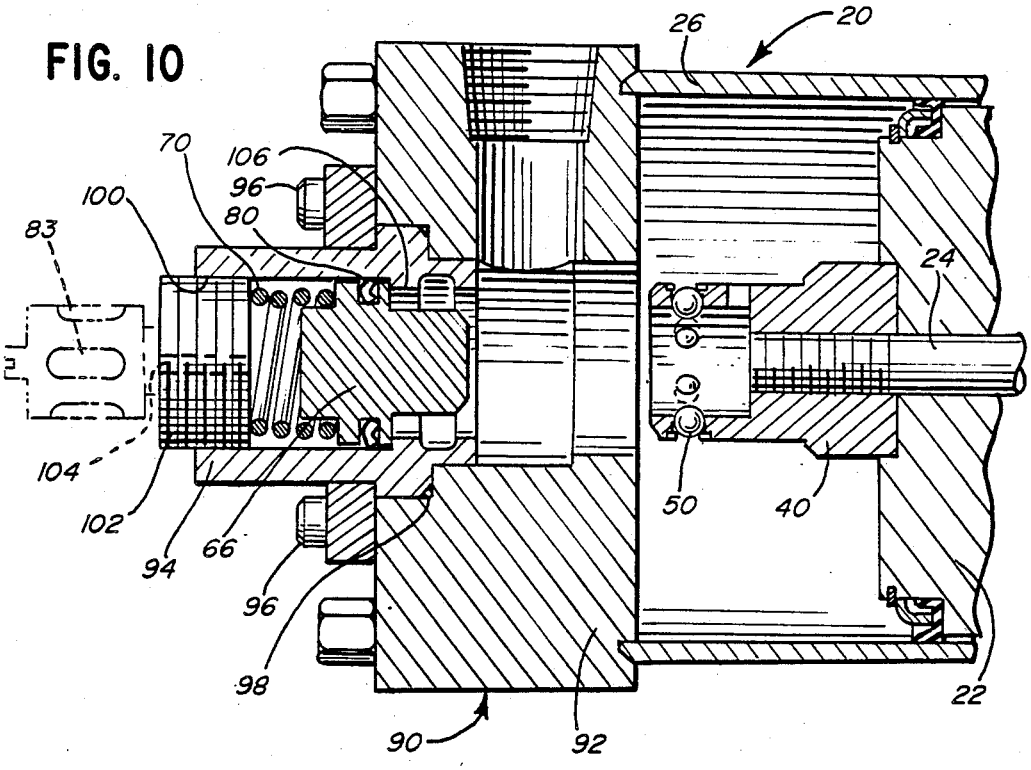

Referring now to FIGS. 9 and 10, there are shown alternative embodiments wherein elements common to these figures and FIGS. 1–8 are illustrated with like numerals.

Referring specifically to FIG. 9, the unitary or integral head 28*a* is replaced by a three-piece head 90 consisting of a main head portion 92 and a two-piece locking plug housing 94 secured to the main head portion 92 by means of bolts 96. A seal 98 prevents pressurized fluid within the cylinder from escaping through the interface between the housing 94 and the main head portion 92.

The embodiment shown in FIG. 9 is somewhat more advantageous than that disclosed in FIGS. 1–8 in that the main head portion 92 is of standard construction while the head 28*a* shown in FIGS. 1–8 is specially fabricated. In the embodiment shown in FIG. 9, only the locking plug housing 94 is of special construction, thereby reducing fabricating costs over the embodiment of FIGS. 1–8.

The embodiment shown in FIG. 9 operates in the same fashion as the embodiment of FIGS. 1–8 and hence will not be described in detail.

Referring to FIG. 10, a still further embodiment of the invention differs from that shown in FIG. 9 in that the back wall of the locking plug housing 94 includes an aperture 100 into which is threaded a cylindrical closure plug 102. The closure plug 102 includes a vent or port 104 similar to the exhaust port 82 and which serves an identical function.

The embodiment of FIG. 10 differs from the embodiment of FIG. 9 in that the snap ring 68 may be replaced by a flange 106 which acts as the stop previously described. Since the interior of the housing 94 can be accessed through the aperture 100, there is no need for a removable element such as the snap ring 68 to serve as the stop, and hence the flange can be utilized in its place.

The embodiment of FIG. 10 is further simplified over that shown in FIG. 9 by permitting access to the interior of the housing 94 to facilitate assembly. The locking plug 66, seal 80 and spring 70 are inserted through the aperture 100 into the housing 94 and assembled therein before the closure plug is threaded into the aperture. The operation of the embodiment shown in FIG. 10 is identical to that shown in FIGS. 1–9.

Figure 11:
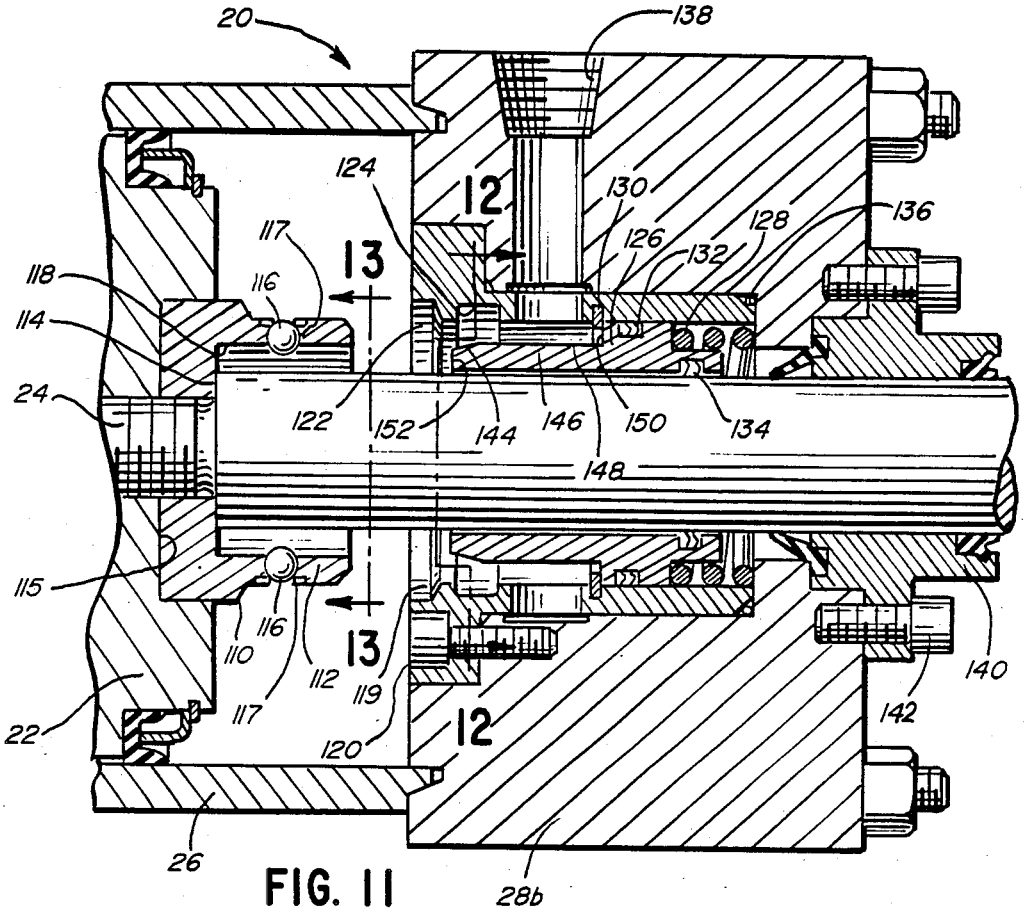
FIG. 11 is a view similar to FIG. 1 showing a still further embodiment of the invention utilized on the rod end of a piston and cylinder device.
Figure 12:
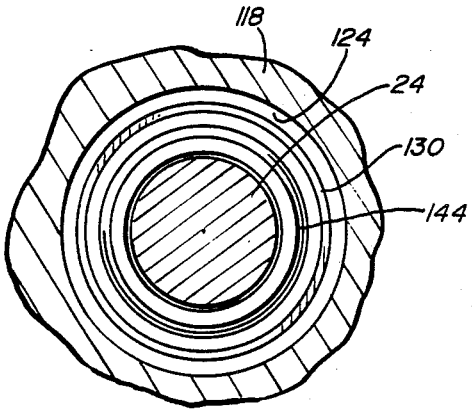
FIG. 12 is a fragmentary sectional view taken along lines 12—12 of FIG. 11.
Figure 13:
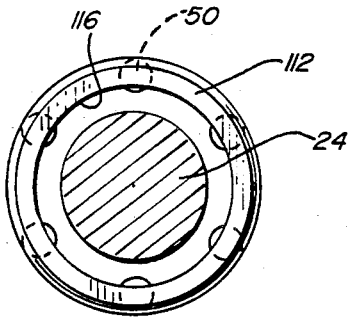
FIG. 13 is a sectional view taken along lines 13—13 of FIG. 11.

Referring now to FIGS. 11–13, there is shown a still further embodiment of the invention for use when it is desired to lock the piston and piston rod at the other extreme position or rod end of the device 20. It should be noted that this embodiment may be used on both ends of a piston for locking same at either extreme position when the device 20 is a double-ended cylinder in which the piston rod exits from both heads 28*a* and 28*b*. The embodiment of FIGS. 11–13 includes a locking plunger or carrier 110 having a sleeve portion 112 analogous to the sleeve 42 disclosed in connection with FIGS. 1–10. The plunger or carrier 110 is disposed between a shoulder 114 of the piston rod and a counterbore 115 of the piston.

Similar to the previous embodiments, the sleeve portion 112 carries a series of ball bearings 116 in radial bores 117 spaced circumferentially about a central axial bore 118 of the sleeve 112. The ball bearings 116 are retained within the radial bores 52 by either of the means shown in FIGS. 2–6 so that they are movable to a locking position wherein they extend outwardly from the sleeve 112.

A locking plug housing 119 is mounted within a stepped bore of the head 28*b* by means of nuts 120, only one of which is shown in FIG. 11. The locking plug housing 119 includes a central axial head bore 122 having a diameter slightly larger than the outer diameter of the locking plunger or carrier 110. A circumferential groove or channel 124, analogous to the groove 64, extends outwardly from the periphery of the axial head bore 122.

A locking plug 126 having an outer diameter slightly less than the diameter of the axial bore in the sleeve 112 is disposed on the piston rod 24 within the plug housing 119. The locking plunger 110, bore 122 and locking plug 126 are concentric with the piston 22 and piston rod 24. A spring 128 biases the locking plug 126 against a stop in the form a snap ring 130 analogous to the ring 68 previously described. Radial seals 132, 134 prevent the escape of pressurized fluid between the locking plug 126 and the plug housing 118 and the piston rod 24, respectively.

A seal 136 prevents pressurized fluid from passing between a fluid port 138 and the backside of the locking plug 126.

Disposed on the end of the head 28*b* is a conventional bushing and rod wiper arrangement 140 which is secured to the head 28*b* by means of bolts 142.

The apparatus shown in FIG. 11 operates similar to the apparatus shown in FIGS. 1–10. As the piston 22 and piston rod 24 approach the extreme position at the rod end of the device 20, a tapered surface 144 of a tapered nose 146 contacts the ball bearings 116, in turn moving the plunger or carrier 110 away from the stop 130. The plunger or carrier 110 continues to move away from the stop 130 until the ball bearings 116 are aligned with the channel or groove 124, at which point the locking plug 126 moves relative to the ball bearings 116 due to the urging of the spring 128. The ball bearings 116 ride up and over the tapered surface 144 onto a cylindrical surface 148 of the nose 146 causing the ball bearings 116 to move into the locking position in the groove or channel 144 and lock the piston and piston rod at the extreme position.

The locking plug 126, similar to the locking plug 66 described above, includes surfaces against which pressurized fluid acts comprising a shoulder 150, the cylindrical surface 148, the tapered surface 144 and an end surface 152. As pressurized fluid is admitted into the cylinder through the fluid port 138, the pressurized fluid pushes against these surfaces and forces the locking plug 126 away from the stop against the urging of the spring 128, thereby releasing the ball bearings 116 from the groove or channel 124. The piston 22 and piston rod 24 are therefore free to move away from the head 138 toward the opposite extreme position.

What is claimed is:

1. Locking apparatus for a piston and cylinder device having a piston disposed on a piston rod and movable in response to fluid pressure toward a head of the device, the head having an axial bore having opposite ends and being coupled to a fluid passage to the interior of the cylinder, comprising:

a locking plunger threaded onto the piston rod for and disposed between the piston and one cylinder head, said locking plunger including a sleeve portion having inner and outer surfaces concentric and circular cylindrical and extending away from the piston toward said cylinder head, locking members mounted in said sleeve portion and movable between a position and a locking position wherein said locking members have portions exposed beyond the outer surface of said sleeve portion;

means forming a circumferential groove extending outwardly in the head from said axial bore;

a locking plug disposed in the axial bore for reciprocation toward and away from the piston, said plug having an outer surface to fit within the inner surface of the plunger sleeve and a tapered nose extending inwardly from said outer surface;

a stop in said head axial bore limiting movement of the locking plug toward the piston, spring means urging the locking plug against the stop, said locking plug tapered nose being axially aligned with and engageable against said locking members as the locking plug and locking plunger telescope one relative to the other, said engaging plug nose and locking members being capable of moving the locking plug against its spring urging to move the locking plunger and locking plug together until said locking members are opposite said circumferential groove so as to ramp up the tapered nose and move radially into the circumferential groove;

said locking members having a size to clear the inner surface of said sleeve when entered into said circumferential groove, so that said locking plug may move its outer surface toward the piston and opposite said locking members to maintain same in the groove holding said piston and rod against further movement.

2. The locking apparatus of claim 1, wherein the piston rod includes an end which extends through the piston and wherein the locking plunger is threaded onto the end of the piston rod.

3. In a piston and cylinder device having a piston on a piston rod and movable between extreme positions within a cylinder in response to the admittance of pressurized fluid therein, the device having a head on each end of the cylinder, one such head having an axial bore with opposite ends, first means carried by the piston cooperating with second means in the axial bore in one of the heads for locking the piston at one extreme position, the improvement comprising:

the first means comprising a carrier threaded onto the piston rod and including a sleeve having an outer circular cylindrical surface of a diameter smaller than the bore in the head in order to enter the bore in usual cushioning of piston travel toward the cylinder head, the sleeve including an interior circular cylindrical surface, said sleeve having radial bores spaced circumferentially and a ball bearing disposed in each such radial bore, said ball bearings being movable to a locking position wherein the balls extend outwardly from the sleeve outer cylindrical surface; and the second means including a head bore located circumferential groove extending outwardly from and intermediate the ends of the bore in the head, a locking plug slidingly movable axially in the bore and having an outer cylindrical surface capable of fitting within the sleeve, a spring for urging the locking plug toward the piston into a first position, the locking plug including a tapered nose engageable with the ball bearings as the piston is moved toward the one extreme position to move the locking plug away from said first position compressing the spring until the ball bearings are in alignment with the groove at which point the spring urges the locking plug to move toward the piston and within the carrier sleeve to the first position moving the ball bearings to the locking position in the groove, the locking plug also including a surface against which pressurized fluid acts to move the locking plug away from the piston to release the ball bearings from the groove and allow the piston to move away from the one head.

* * * * *